US008104724B2

(12) United States Patent
Sorohan

(10) Patent No.: US 8,104,724 B2
(45) Date of Patent: Jan. 31, 2012

(54) STABILISING DEVICE

(76) Inventor: Frank Sorohan, Malahide (IE)

( * ) Notice: Subject to any disclaimer, the term of this patent is extended or adjusted under 35 U.S.C. 154(b) by 0 days.

(21) Appl. No.: 12/597,060

(22) PCT Filed: Apr. 23, 2008

(86) PCT No.: PCT/EP2008/054953

§ 371 (c)(1),
(2), (4) Date: Apr. 19, 2010

(87) PCT Pub. No.: WO2008/129065

PCT Pub. Date: Oct. 30, 2008

(65) Prior Publication Data

US 2010/0224742 A1 Sep. 9, 2010

(30) Foreign Application Priority Data

Apr. 23, 2007 (IE) ..... S2007/0294

(51) Int. Cl.
*F16M 11/24* (2006.01)

(52) U.S. Cl. ..... 248/188.3; 248/188.9

(58) Field of Classification Search ..... 248/188.3, 248/188.2, 188.8, 188.9
See application file for complete search history.

(56) References Cited

U.S. PATENT DOCUMENTS

| | | | | |
|---|---|---|---|---|
| 3,768,766 | A * | 10/1973 | Bain | 248/188.2 |
| 7,431,248 | B2 * | 10/2008 | Coumoyer et al. | 248/188.2 |
| 2008/0190696 | A1 * | 8/2008 | Pike et al. | 182/202 |
| 2010/0071599 | A1 * | 3/2010 | McEntire | 108/50.11 |

FOREIGN PATENT DOCUMENTS

| | | | |
|---|---|---|---|
| CH | 663338 | A5 | 12/1987 |
| DE | 202006003763 | U1 | 1/2006 |
| EP | 0186714 | A1 | 9/1986 |

OTHER PUBLICATIONS

International Search Report, dated May 8, 2009, in international patent application No. PCT/EP2008/054953, 3 pgs.

* cited by examiner

*Primary Examiner* — Ramon Ramirez
(74) *Attorney, Agent, or Firm* — Holland & Knight LLP; Brian J. Colandreo, Esq.; Jeffrey T. Placker, Esq.

(57) ABSTRACT

The present invention relates to a stabilising device for stabilising an object having a plurality of support elements on a surface, particularly objects that are moved frequently such as garden furniture or the tables or restaurant terraces. The stabilising device comprises a plurality of fluid-containing compartments which are in fluid communication with each other by way of a restricted flow mechanism such that they are each variable in height in response to the amount of fluid contained therein and are located between the support elements and the surface. The stabilising device eliminates the requirement for using a valve to control the flow of fluid by using the restricted flow mechanism comprising a plurality of interconnected narrow-bore hoses.

7 Claims, 5 Drawing Sheets

STABILISING DEVICE

RELATED APPLICATIONS

The subject application is a U.S. National Stage application that claims the priority of International Application No. PCT/EP2008/054953, filed on 23 Apr. 2008, which claims the priority of Irish National Application No.: S2007/0294, filed on 23 Apr. 2007, the contents of which are herein incorporated by reference in their entirety.

INTRODUCTION

The present invention relates to a stabilising device for stabilising an object having a plurality of support elements on a surface, the stabilising device comprising a plurality of fluid-containing compartments, wherein each fluid-containing compartment is in fluid communication with the other fluid-containing compartments by way of a restricted flow mechanism; is variable in height in response to the amount of fluid contained within the fluid-containing compartment; and engages a support element of the object such that the weight of the object acts on the surface through that fluid-containing compartment. Such devises are well known for use in stabilising or levelling objects such as tables, chairs and the like.

Most people are familiar with the problem of an unstable or rocking table or chair, either caused by the legs of the table or chair being unequal in length or being located on an uneven supporting surface. In such cases, all of the legs of the piece of furniture will not engage the ground at one time, resulting in a rocking motion if a force is exerted on the piece of furniture, such as a user leaning or placing something on a table. This rocking motion is inconvenient and uncomfortable for those using the table or sitting on the chair. For example, an unsteady table of this nature is inconvenient as objects on the tabletop can be disturbed by the movement of the table, even possibly resulting in spillages or breakages. Furthermore, it is uncomfortable for the users of the table to have to deal with a rocking surface as they lean on the table.

There are a number of solutions available to this problem, the most basic being the use of a wedge, such as a piece of paper or card, placed under one or more of the legs of the piece of furniture so as to reduce or eliminate the rocking. This method can be quite useful but it will be understood that it is also inconvenient and unsightly. A further available solution is to fit the legs of the piece of furniture in question with adjustable, screw threaded feet that allow the length of each leg to be adjusted as necessary. Again this is an inconvenient solution.

Finally, there are a number of solutions involving the use of bellows or like devices fitted to the foot of each leg and interconnected by means of pipes such that fluid can flow between the bellows, wherein the fluid flow in controlled by a valve. One such device is disclosed in European Patent Application No. 0 186 714. This document describes an apparatus comprising a number of bellows interconnected by a number of conduits to a central valve. The valve must be adjusted to ensure that the correct amount of fluid is present in each bellows to stabilise the object and then the valve can be locked off.

The disadvantage of all of the above-mentioned solutions is that they require user intervention to obtain a stabilised object. This is not a terrible disadvantage if being used on an object such as a kitchen table or washing machine, which will be put in position, stabilised and then left in that arrangement for a long period of time. If however the object to be stabilised is going to be moved frequently, for example garden furniture or restaurant terrace furniture, it is inconvenient and undesirable to have to adjust the stabilising system each time the object is moved.

It is an object therefore of the present invention to provide a stabilising device that provides for simple and convenient stabilising of an object.

STATEMENTS OF INVENTION

According to the invention there is provided a stabilising device for stabilising an object having a plurality of support elements on a surface, the stabilising device comprising a plurality of fluid-containing compartments, wherein each fluid-containing compartment

- is in fluid communication with the other fluid-containing compartments by way of a restricted flow mechanism;
- is variable in height in response to the amount of fluid contained within the fluid-containing compartment; and
- engages a support element of the object such that the weight of the object acts on the surface through that fluid-containing compartment, characterised in that
- the restricted flow mechanism comprises a plurality of interconnected narrow bore hoses.

In this way, the weight of the object acting on the fluid-containing compartments will cause fluid to flow from some compartments to others through the narrow-bore hoses until the object is stabilised and all support elements contact the surface. The use of narrow-bore hoses is a particularly simple and effective way of providing a restricted flow mechanism as only the network of interconnected hoses are required, no further devices such as valves or the like are required to restrict the rate of flow of fluid between the compartments. The stabilisation will occur automatically once the object is placed on the surface and there is no requirement for a user to open or close any valves at the start or finish of the stabilisation process. Additionally, the narrow-bore hoses ensure that the fluid flow is slow so that the stabilisation will occur in a smooth manner. Furthermore, the narrow bore hoses restrict the flow of fluid sufficiently to ensure that the stabilising device will not react immediately to transient effects such as someone leaning on a table as they stand up.

In a further embodiment of the invention there is provided a stabilising device in which the narrow-bore hoses have an internal diameter of approximately 2 mm. This is a particularly effective dimension of narrow-bore hose, allowing efficient operation of the stabilising device.

In another embodiment of the invention there is provided a stabilising device in which the narrow-bore hoses are interconnected by way of a central filling device. This is seen as a particularly efficient way to link the fluid-containing compartments and furthermore allows the fluid-containing compartments of the stabilising device to be primed with fluid before operation.

In one embodiment of the invention there is provided a stabilising device in which each fluid-containing compartment is retained within a housing. This is a particularly efficient way of implementing the present invention, as the housing provides a robust enclosure for the fluid-containing compartments.

In a further embodiment of the invention there is provided a stabilising device in which the housing comprises a support element engaging section and a surface engaging section, which is slidably mounted in the support element engaging section. This allows the housing to efficiently accommodate the invention by allowing the variation in height of the fluid-containing compartment to adjust the housing as necessary.

In another embodiment of the invention there is provided a stabilising device in which the surface engaging section of the housing comprises a boss which abuts against the fluid-containing compartment. This is a particularly efficient way of implementing the housing and variable height of the fluid-containing compartment.

In one embodiment of the invention there is provided a stabilising device in which the fluid-containing compartment comprises a flexible bladder. This is a particularly effective way of providing the fluid-containing compartment.

In a further embodiment of the invention there is provided a stabilising device in which the bladder is substantially hemispherical in shape. This is a particularly advantageous arrangement of bladder.

According to the invention there is further provided an object having a plurality of support elements wherein the object comprises the stabilising device according to the invention. Such an object would not be susceptible to rocking on an uneven surface.

DETAILED DESCRIPTION OF THE INVENTION

The invention will now be more clearly understood from the following description of an embodiment thereof given by way of example only with reference to the accompanying drawings in which:—

Figure 1:
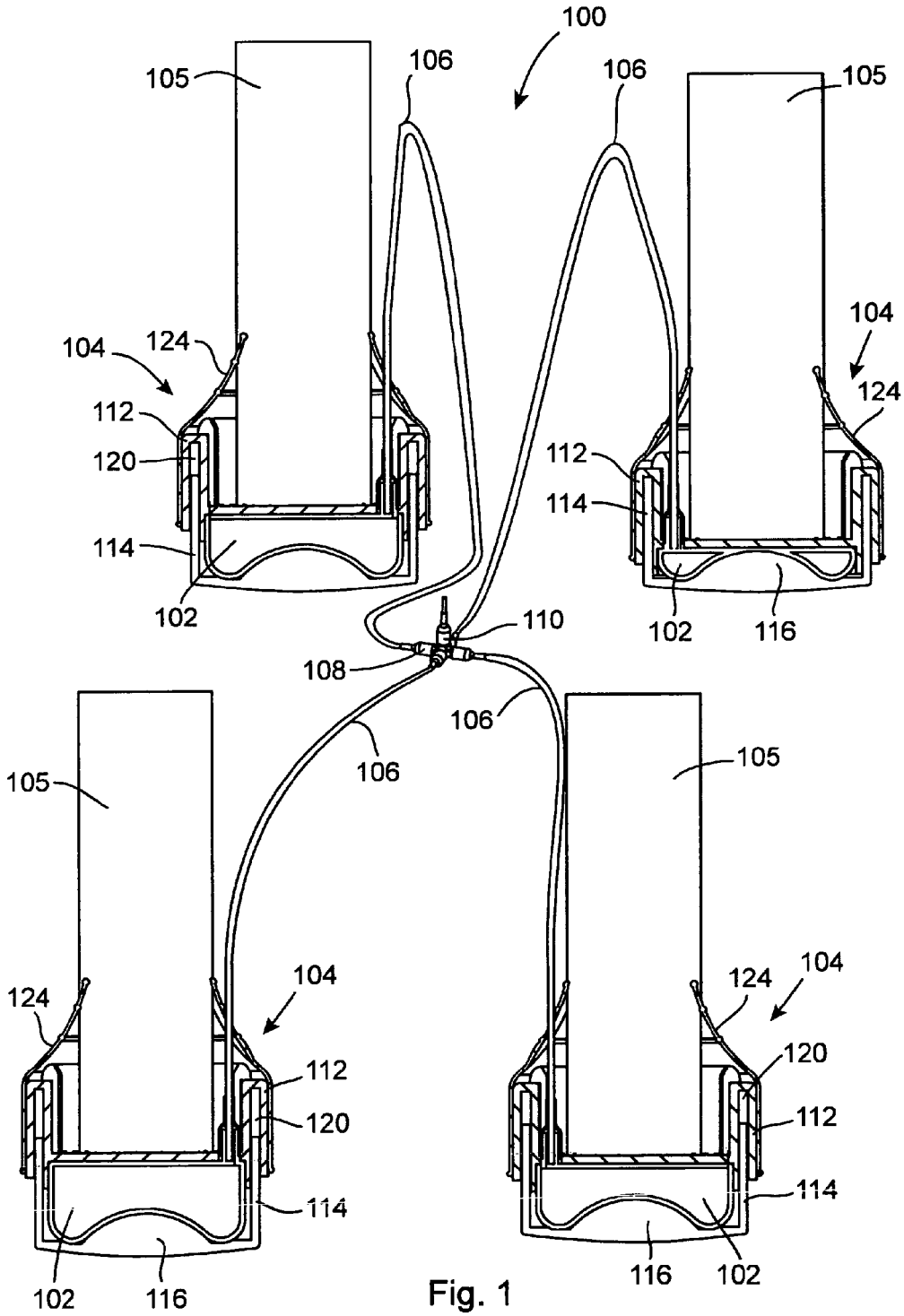
FIG. 1 is a cross-section view of the stabilising device of the invention shown engaging the support elements of an object.

Referring to the drawings, and initially to FIG. 1 thereof, there is shown a stabilising device indicated generally by the reference numeral 100, comprising four fluid-containing compartments 102 each contained within a housing indicated generally by the reference numeral 104, which is mounted on a support element 105, such as a leg, of an object (not shown). A narrow-bore hose 106 is connected to each fluid-containing compartment 102 such that the narrow-bore hose 106 is the only point of egress for fluid contained within the fluid-containing compartment 102. The free ends of the four narrow-bore hoses 106 are fitted with a connection fitting 108 and are connected together at a central filling device 110, such that the four fluid-containing compartments 102, narrow-bore hoses 106 and central filling device 110 form a closed system.

Figure 2:
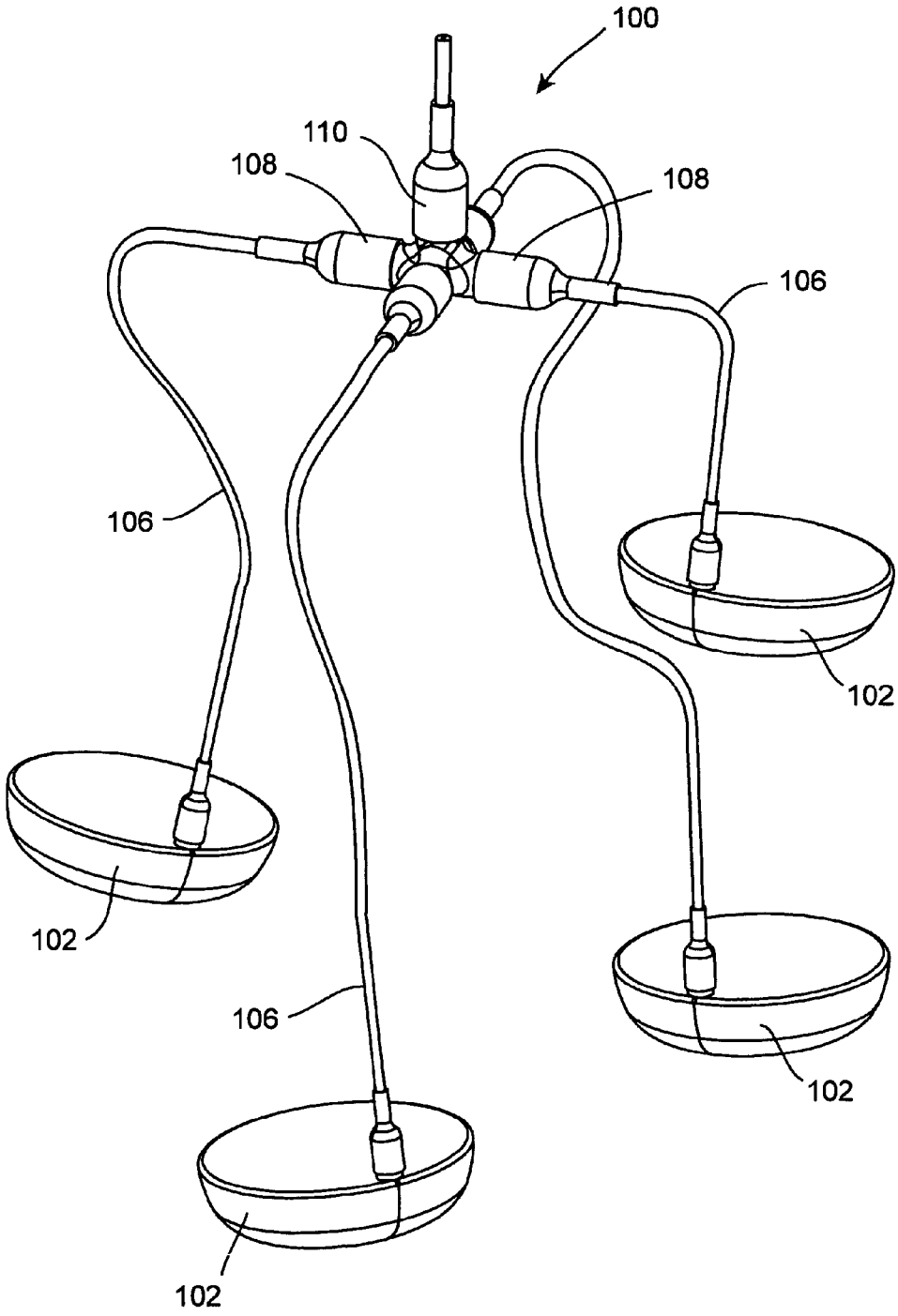
FIG. 2 is a diagrammatic representation of fluid-containing compartments and narrow-bore hoses of the invention.

Referring now to FIG. 2, in which like parts have been given the same reference numerals as above, there is shown the closed system of the fluid-containing compartments 102, narrow-bores hoses 106 and central filling device 110. Each fluid-containing compartment 102 comprises a bladder formed from a flexible material such as natural or synthetic rubber. The bladder is substantially hemispherical in shape, with its flat face lying substantially horizontally, and its curved face protruding downwards therefrom.

Figure 3:
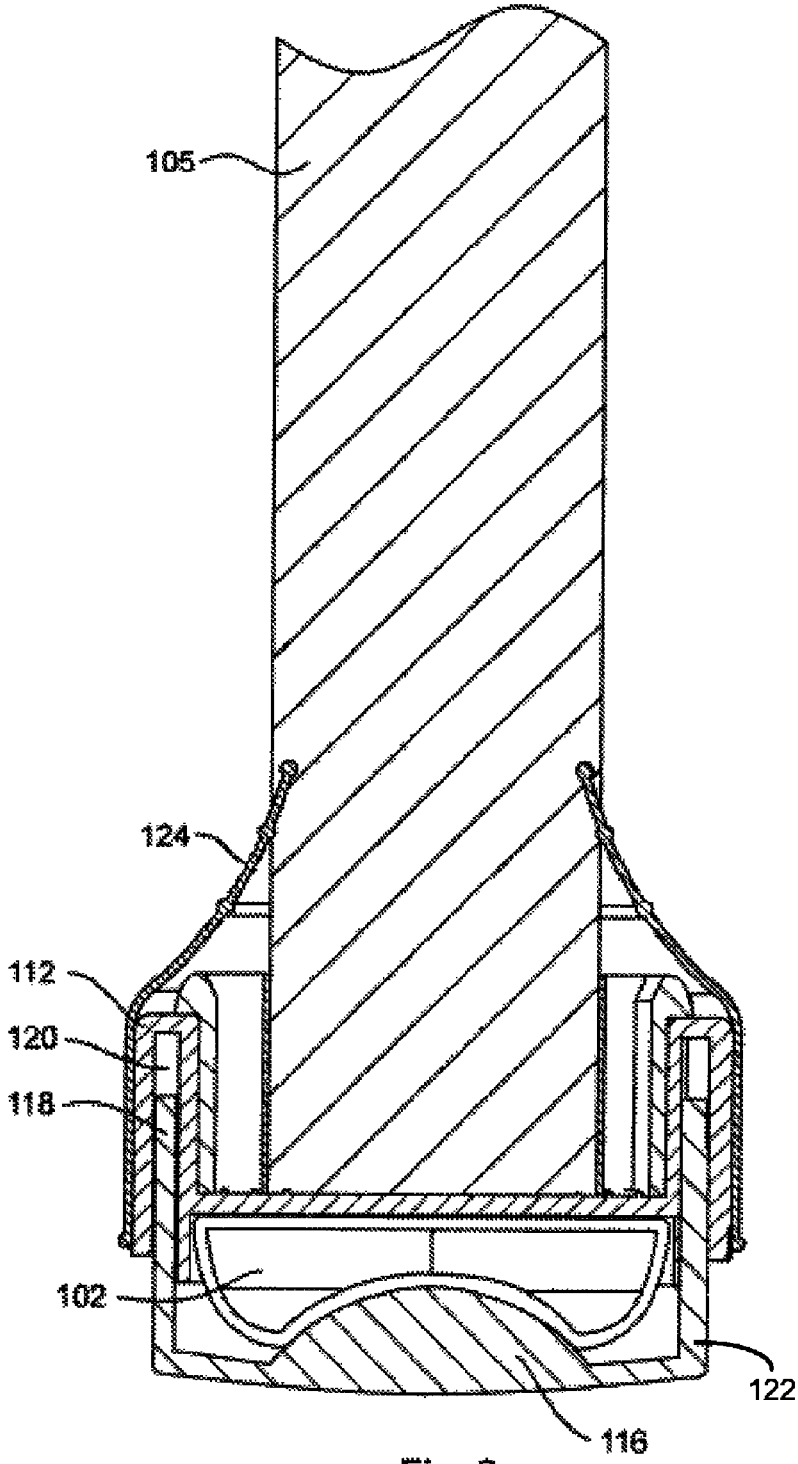
FIG. 3 is a perspective view of a support element of an object engaging part of the invention.
Figure 4:
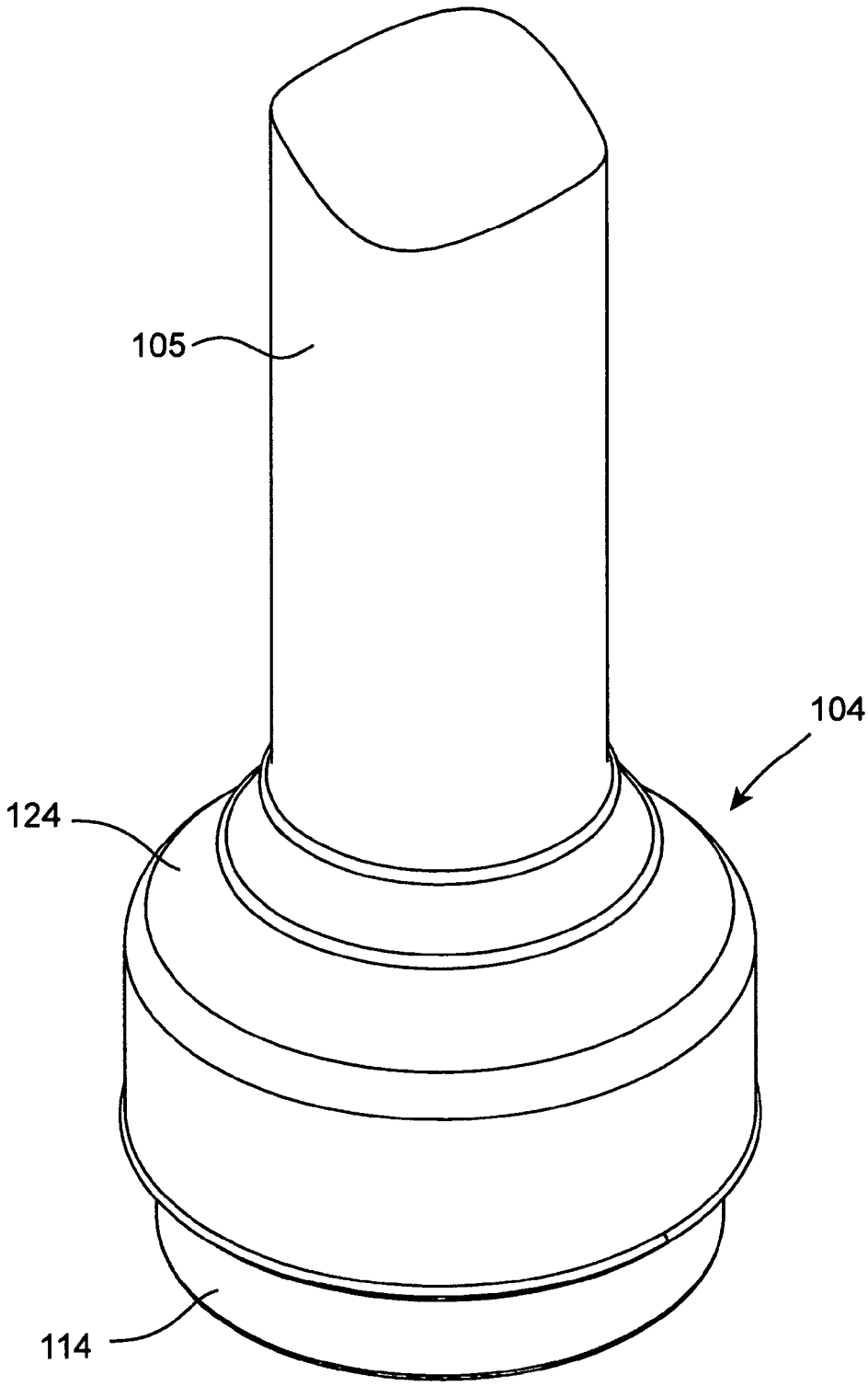
FIG. 4 is a cross-section view of a support element of an object engaging part of the invention.

Referring now to FIGS. 3 and 4, the housing 104 comprises a support element engaging section 112 and a surface engaging section 114. The surface engaging section 114 of the housing 104 comprises a substantially cylindrical body closed at its base. A boss 116, having the shape of a sphere segment, is formed on the inside of this closed end of the surface engaging section 114 and is located centrally thereon. The surface engaging section 114 is slidably mounted within the support element engaging section 112, the side wall 118 of the open end of the cylindrical body engaging a complimentary recess 120 in the support element engaging section 112. The height of the housing is therefore variable according to the degree that the side wall 118 engages the recess in the support element engaging section 112. The support element engaging section 112 comprises a substantially cylindrical socket 122 having a socket side wall and a base for reception of the foot of a support element. The socket further comprises a plurality of flexible fingers which allow the socket 122 to accommodate a variety of sizes and shapes of support element. A skirt 124 surrounds the support element engaging section 112 and extends upwardly therefrom, decreasing in diameter so as to surround and rest against the support element 105. In this way, the skirt 124 lightly grips the support element 105 and so helps to secure the housing 104 thereto. The skirt 124 further serves the purpose of providing a uniform appearance to the housing 104.

The fluid-containing compartments 102 are located in the housing 104 above the boss 116 of the surface engaging section 114 and below the base of the support element engaging section. The fluid-containing compartments comprise a bladder formed from a flexible material such as natural or synthetic rubber. The bladder is substantially hemispherical in shape, with its flat face lying directly below the base of the support element engaging section of the housing, and its curved face protruding downwards into the surface engaging section 114. The lower part of the curved face of the bladder rests against the spherical segment shaped boss 116 and deforms to match the shape of the boss, thereby forming an indentation in the bladder. This indentation due to the boss reduces the volume of the fluid-containing compartment.

In use, the stabilising device 100 is first primed by filling each fluid-containing compartment 102 and their associated narrow-bore hoses 106 completely with fluid and then compressing one fluid-containing compartment 102 so as to expel fluid from the system, leaving sufficient room for fluid to flow between the fluid-containing compartments 102. The fluid containing compartments 102 are filled using the central filling device which is left unsealed during the priming stage. Sufficient fluid is added to the stabilising device 100 to ensure that the narrow-bore hoses are filled with liquid. The central filling device 110 is then also filled with fluid and any air is removed from the system. The central filling device 110 is then closed fully so that no fluid can escape the stabilising device 100 and further so that no air can enter the stabilising device 100.

Once the stabilising device 100 has been primed in this manner, it is ready to be fitted to the object in question. A fluid-containing compartment 102 is fitted to the ground engaging foot of each support element 105 such that the foot of the support element 105 is positioned on the base of the socket 122 of the support element engaging section 112 of the housing 104. The narrow-bore hoses 106 and central filling device 110 are secured to the support elements 105 and the object (not shown). Once the object (not shown) is placed on a surface, its weight will act through the fluid-containing compartments 102, thereby forcing fluid to flow between the fluid containing compartments 102 via the narrow-bore hoses 106 until the pressure in each fluid-containing compartment 102 is the same. For example, in a situation where one leg of a four-legged object is placed over a dip in the ground, the other three legs of the object will be resting on the ground and the first leg will not be in contact with the ground. The weight of the object will act on the ground through the fluid-containing compartments 102 fixed to the three legs of the object in contact with the ground. In this way, the support element engaging section 112 associated with each fluid-containing compartment 102 attached to each support element 105 will be pushed down onto the surface engaging section 114, thereby reducing the volume of the fluid-containing compartments 102 and reducing the height of the support element engaging section 112 above the surface engaging section 114. This effectively reduces the length of the associated support element. Fluid contained within the fluid-containing compartments 102 will be pushed out of through the narrow-bore hoses 106. The fluid will flow through the narrow-bore hoses 106 to the central filling device 110 and from there to the fluid-containing compartment 102 associated with the leg that is over the dip, as there will be little or no pressure acting on this fluid-containing compartment 102. The fluid-containing compartment 102 associated with the leg located over the dip will therefore expand as fluid is pumped into it and will push the surface engaging section 114 away from the support element engaging section 112, increasing the height of the housing 104 and thus effectively increasing the length of that leg of the table. Fluid will continue to flow until sufficient fluid has arrived at the fluid-containing compartment 102 associated with the leg located over the dip to increase the length of that leg such that the leg engages the ground. At this point pressure will begin to be exerted on the fluid-containing compartment 102 associated with that leg. When the pressure exerted on the fluid in the fluid-containing compartment 102 associated with the leg located over the dip is equal to that exerted on the fluid in the other three fluid-containing compartments, fluid flow will stop. The pressure in each fluid-containing compartment 102 will be equal and each of the four legs of the object will be in contact with the ground, via fluid containing compartments 102. The object will therefore be stable on the ground.

Figure 5:
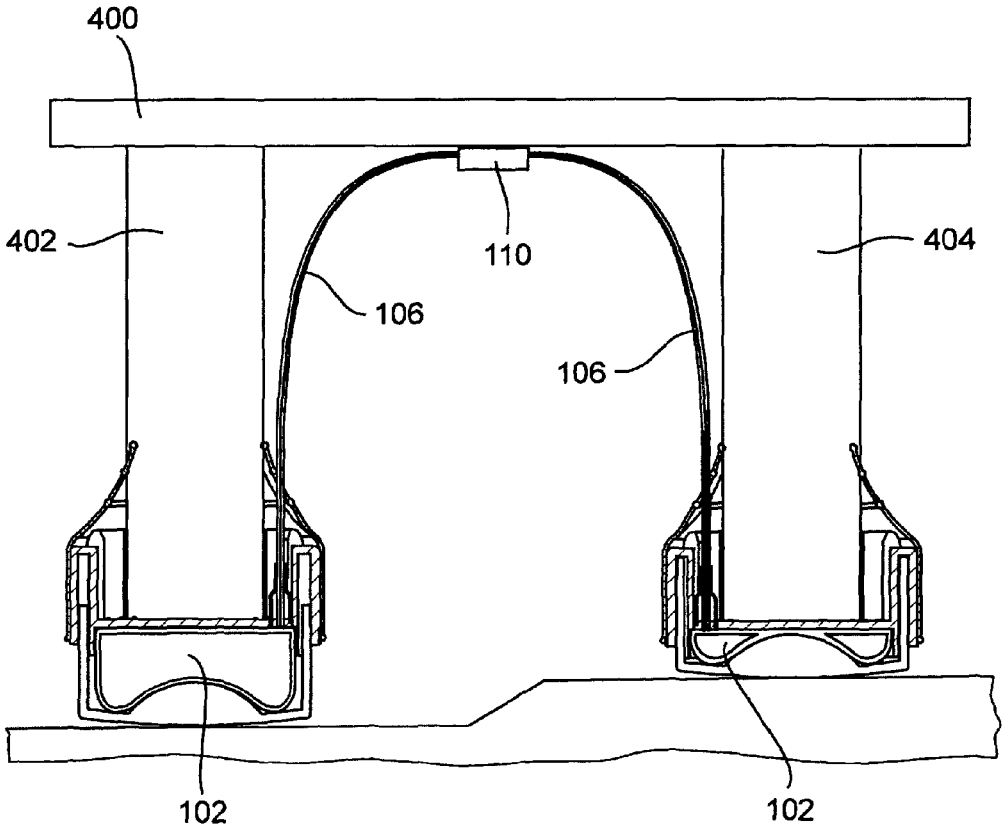
FIG. 5 shows the invention in place on a table (only two support elements shown).

Referring now to FIG. 5, in which like parts have been given the same reference numerals as above, there is shown a table 400 having a first leg 402 and a second leg 404 (further legs not shown). Each of the legs 402, 404 is fitted with the fluid-containing compartment 102 and housing 104 of the invention, and the narrow-bore hoses 106 extend up the legs to the central filling device which is secured in position on the underside of the tabletop. The table 400 is located on an uneven surface such that the first leg 402 rests at a lower point on the surface than the second leg 404 rests. The stabilising device 100 is shown in a equilibrium position wherein both legs have come to rest on the surface, which has been achieved by the fluid containing compartment 102 of the second leg 404 being fully compressed such that the side wall 118 of the open end of the cylindrical body of the surface engaging section 114 are fully inserted into the complimentary recess 120 in the support element engaging section 112, while the fluid containing compartment 102 of the first leg has expanded such that the surface engaging section 114 of the housing attached to the first leg has been pushed downwards so as to extend the length of the housing and consequently the first leg.

Due to the narrow-bore hoses 106 fluid flow between each fluid-containing compartment 102 will be quite slow. This will ensure that the stabilising device will not react to transient forces exerted on the table such as a person leaning on the table as they stand up.

Throughout the specification, the term fluid is used in relation to the operation of the stabilising device. The fluid used could be water, oil, hydraulic fluid, or any other suitable fluid. If a liquid is to be used it is preferable that the liquid be substantially incompressible. Ideally, a liquid such as an anti-freeze solution or colligative agent is used.

It will be understood that the compartment may be of any configuration that will allow it to be secured to the support member of an object such that the weight of the object will act through the compartment. Furthermore, it will be understood that the housing and parts comprised therein may be shaped to match a particular shape of table leg, for example, round, square or right-angled.

While the stabilising device of the invention has been described as being a separate entity to the object to be stabilised, it will be understood by the person skilled in that art that it may also be integrated into that object at manufacture or subsequently. For example, fluid-containing compartments may be formed at the foot of the support element of the object such that the outside of the fluid-containing compartment matches that of the leg, or alternatively a housing surrounding the fluid containing compartment may be adapted to match the leg. Additionally, the narrow-bore hoses may be formed or fitted in a cavity or channel in the support elements.

Ideally, the walls of the bladder forming the fluid-containing compartment are only minimally elastic or expandable, such that any variation of the volume of the fluid-containing compartment is due to the flexible nature of the bladder walls and is not due to an expansion or contraction of the bladder walls. Further it will be understood that the shape of the bladder may vary and may comprise a conoid shape, a variation of a conoid shape or another suitable shape.

Throughout the specification the term fluid-containing compartment has been used to refer to a compartment containing a fluid suitable for operation of the invention. It also refers to and includes that same compartment when empty of the fluid suitable for operation of the invention due to compression of the compartment; the presence of a vacuum surrounding the compartment; or if the compartment is partially or fully filled with air.

In the specification the terms comprise, comprises, comprised and comprising or any variation thereof and the terms include, includes, included or including or any variation thereof are considered to be totally interchangeable and they should all be afforded the widest possible interpretation.

The invention is not limited to the embodiment herein described, but may be varied in both construction and detail within the terms of the claims.

The invention claimed is:

1. A stabilising device for stabilising an object having a plurality of support elements on a surface, the stabilising device comprising a plurality of fluid-containing compartments wherein each fluid-containing compartment is in fluid communication with the other fluid-containing compartments by way of a restricted flow mechanism;

is variable in height in response to the amount of fluid contained within the fluid-containing compartment and engages a support element of the object such that the weight of the object acts on the surface through that fluid-containing compartment characterised in that the restricted flow mechanism comprises a plurality of interconnected narrow-bore hoses;

wherein each fluid-containing compartment is retained within a housing, and wherein the housing includes a support element engaging section and a surface engaging section which is slidably mounted in the support element engaging section.

2. A stabilising device as claimed in claim 1 in which the narrow-bore hoses have an internal diameter of approximately 2 mm.

3. A stabilising device as claimed in claim 1 in which the narrow-bore hoses are interconnected by way of a central filling device.

4. A stabilising device as claimed in claim 1 in which the surface engaging section of the housing comprises a boss which abuts against the fluid-containing compartment.

5. A stabilising device as claimed in claim 1 in which the fluid-containing compartment comprises a flexible bladder.

6. A stabilising device as claimed in claim 5 in which the bladder is substantially hemispherical in shape.

7. An table having a plurality of support elements wherein the table is fitted with a stabilising device comprising:

a plurality of fluid-containing compartments wherein each fluid-containing compartment is in fluid communication with the other fluid-containing compartments by way of a restricted flow mechanism;

is variable in height in response to the amount of fluid contained within the fluid-containing compartment and engages a support element of the object such that the weight of the object acts on the surface through that fluid-containing compartment characterised in that the restricted flow mechanism comprises a plurality of interconnected narrow-bore hoses;

wherein each fluid-containing compartment is retained within a housing, and wherein the housing includes a support element engaging section, fitted to a respective one of the plurality of support elements of the table, and a surface engaging section which is slidably mounted in the support element engaging section.

* * * * *